US005543687A

United States Patent [19]

Woyke et al.

[11] Patent Number: 5,543,687

[45] Date of Patent: Aug. 6, 1996

[54] HYDROGEN-GAS DISCHARGE LAMP

[75] Inventors: Thomas Woyke, Aachen; Tilman Schober, Inden, both of Germany

[73] Assignee: Forschungszentrum Julich GmbH, Julich, Germany

[21] Appl. No.: 354,497

[22] Filed: Dec. 12, 1994

[30] Foreign Application Priority Data

Dec. 16, 1993 [DE] Germany ..... 43 42 941.6

[51] Int. Cl.[6] ..... H01J 17/24; H01J 17/20; H01J 17/16; H05B 41/16

[52] U.S. Cl. ..... 313/556; 313/560; 313/561; 313/562; 313/573; 313/637; 315/248

[58] Field of Search ..... 313/556, 560, 313/561, 562, 573, 634, 637, 439, 553, 554, 555; 252/301.4 R, 301.4 H

[56] References Cited

U.S. PATENT DOCUMENTS

| | | | |
|---|---|---|---|
| 3,851,214 | 11/1974 | Young | 313/556 |
| 3,904,907 | 9/1975 | Young | 313/562 |
| 3,946,272 | 3/1976 | Young | 313/556 |
| 4,451,765 | 5/1984 | Gray | 313/556 |

OTHER PUBLICATIONS

Dieke, G. H. & Cunningham, S. P. "A New Type of Hydrogen Discharge Tube" J. Opt. Soc. American 1952, 42, pp. 187–189.

T. Tanabe et al, "Isotope Effect in Dissociation of Uranium Hydride" J. Nuclear Science & Technol., 1979, 16, 7 pages.

R. D. Penzhorn et al, "Evaluation of ZrCo and other getters for Tritium Handling and Storage", J. of Nuclear Materials 170 (1990), pp. 217–231.

*Primary Examiner*—Sandra L. O'Shea
*Assistant Examiner*—John Ning
*Attorney, Agent, or Firm*—Herbert Dubno

[57] ABSTRACT

A hydrogen discharge lamp has a glass lamp enclosure formed with a radiation-emitting window and receiving a body of a zirconium-cobalt alloy forming in part a hydride which constitutes a reservoir for hydrogen or deuterium and enabling controlled liberation of the hydrogen or deuterium from the reservoir. The zirconium-cobalt alloy simultaneously forms a getter for elements interfering with spectral purity of a hydrogen discharge emission from the lamp. An electrical discharge is effected in the hydrogen or deuterium liberated in the enclosure to cause the emission of light through the window.

7 Claims, 3 Drawing Sheets

HYDROGEN-GAS DISCHARGE LAMP

FIELD OF THE INVENTION

Our present invention relates to a hydrogen-gas discharge lamp and, more particularly, to a discharge lamp in which hydrogen gas determines the emission line which predominates and which contains a material constituting a reservoir for hydrogen and/or deuterium as well as a getter for detrimental gases.

BACKGROUND OF THE INVENTION

A hydrogen-gas discharge lamp can comprise a bulb composed of glass and having a radiation-emission window through which an emitted radiation emerges from the lamp. The lamp can be provided with a material serving as a reservoir for hydrogen and/or deuterium as well as a reservoir for hydrogen and/or deuterium as well as a getter for gaseous components which might interfere with the purity of the emission. Means is provided to excite the hydrogen and/or deuterium which is liberated in the bulb.

Hydrogen gas discharge lamps of this type are known. The hydrogen reservoir/getter combination was formed by uranium in such systems (see Dieke, G. H. and Cunningham, S. P. *A New Type of Hydrogen Discharge Tube*, J. Opt. Soc. America, 1952, 42, 187–189).

The use of a hydrogen reservoir/getter combination is advantageous on two grounds. Firstly, a Lyman-α lamp (a hydrogen discharge lamp with the principal emission being the Lyman-α line of 121.56 nm as a line source) must have a relatively low hydrogen partial pressure of the order of magnitude of 1 Pa since with higher pressures, the emission lines of molecular hydrogen are more pronounced than the Lyman-α line. Because of the diffusion of hydrogen through glass, the filling of the bulb with hydrogen at such low partial pressures can result in a lamp with a very limited life span. For this reason it has been found to be advantageous to liberate the hydrogen progressively by thermal means from a metal hydride forming the hydrogen reservoir. The partial pressure of the hydrogen is then determined by the temperature of the hydride. This can be calculated from the van 'T Hoff equation $$\mathrm{Log}_{10}p = -\frac{A}{T} + B$$

In this equation p represents the hydrogen partial pressure and T the absolute temperature. A and B are parameters specific to the material. For example, typical values for A and B for uranium (p in Pa) are: A=4366 and B=11.26 (*Isotope Effect in Dissociation of Uranium Hydride*, Nuclear Science and Technol., (1979), 16, 690–696).

To obtain the hydrogen partial pressure for operation of a Lyman-α lamp, a temperature of about 100° C. should be used.

The second ground for utilizing a hydrogen reservoir/getter combination is the spectral purity of the lamp. Foreign atoms or molecules which may remain trapped in the bulb or penetrate into the lamp by diffusion also emit electromagnetic radiation at wavelengths characteristic of the respective atoms. To ensure high spectral purity, these atoms or molecules must be removed from the gas space. This can be achieved with the getter characteristics of uranium. Uranium reacts with a variety of foreign atoms to bind them chemically so that they no longer are involved in the emission process in the lamp.

Use of uranium as a hydrogen reservoir, however, has a number of drawbacks which are intrinsic to the characteristics of this material:

Uranium is radioactive

Finely divided uranium is pyrophoric, i.e. it ignites in contact with air.

The use of uranium requires observance of environmental laws, requires special permits and requires special care in handling.

Uranium is poisonous.

Because of the short useful life of a Lyman-α lamp (several tens of hours), the use of uranium in such lamps creates disposal problems.

Safe handling of uranium requires the use of inconvenient glove boxes.

The availability of uranium can be a problem.

OBJECTS OF THE INVENTION

It is, therefore, the principal object of the present invention to provide a hydrogen gas discharge lamp which is free from the drawbacks of lamps using uranium as the hydrogen/deuterium reservoir and getter.

Another object of the invention is to provide a hydrogen discharge lamp with high spectral purity, easy disposability and the possibility of fabrication without the drawbacks hitherto encountered with the production of such lamps.

It is another object of this invention to provide an improved hydrogen discharge lamp in which uranium is replaced as a hydrogen reservoir and getter, but which nevertheless has high spectral purity.

SUMMARY OF THE INVENTION

These objects and others which will become apparent hereinafter are attained, in accordance with the invention, in a hydrogen discharge lamp in which a zirconium-cobalt alloy, preferably having an atomic ratio of zirconium to cobalt of 1:1 is substituted for uranium as the combination hydrogen/deuterium reservoir and as the getter. zirconium-cobalt alloy as the hydrogen reservoir and getter is inexpensive and rapid.

Finally, lamps using zirconium-cobalt as the hydrogen reservoir and getter can be disposed of without problems.

The hydrogen discharge lamp of the invention comprises:

a glass lamp enclosure formed with a radiation emitting window; and means on the enclosure receiving a body of a zirconium-cobalt alloy forming in part a hydride constituting a reservoir of at least one element selected from the group which consists of hydrogen and deuterium for controlled liberation thereof from the reservoir, the zirconium-cobalt alloy simultaneously forming in part a getter for elements interfering with spectral purity of a hydrogen discharge emission from the lamp.

Advantageously the glass lamp enclosure has a bulb formed with the window and provided with means for exciting gas in the bulb to produce the discharge, the means on the enclosure receiving the body of a zirconium-cobalt alloy including a sidearm containing the body of the zirconium-cobalt alloy and communicating with the bulb.

Advantageously, a fritted glass plate is provided between the body of the zirconium-cobalt alloy and the bulb. This body of zirconium-cobalt alloy can be a mass of finely-divided material, i.e. a fine powder.

The invention also relates to a method of making a hydrogen discharge lamp which comprises the steps of:

By substituting ZrCo as the hydrogen reservoir/getter, we can obtain a hydrogen discharge lamp which emits the Lyman-α line with high spectral purity, i.e. a Lyman-α lamp, with emission of other wavelengths in the neighboring range between 110 to 150 nm with very suppressed intensities.

The lamp, therefore, has a multiplicity of advantages:

The nonradioactive zirconium-cobalt alloy is substantially less expensive and more readily obtainable than uranium.

The zirconium-cobalt alloy is not poisonous or toxic and is not pyrophoric.

The preparation of the lamp does not require the use of glove boxes. The occupational hazard laws which must be complied with in the case of zirconium-cobalt alloys are significantly less strict than is the case with uranium.

The spectral purity of a Lyman-α lamp utilizing the zirconium-cobalt reservoir/getter is comparable to that of a uranium-containing lamp. With the use of zirconium-cobalt alloy as the hydrogen reservoir, the temperature required for liberating the hydrogen is of the same order of magnitude as that required for a uranium-containing lamp so that the heating and temperature control for the lamp can utilize existing systems with only the most minor modifications. The same applies for the apparatus used in production of the lamps, the furnace, the glass type, etc. Conversion of the fabrication process to the use of (a) forming a glass lamp enclosure with a radiation emitting window, and means on the enclosure receiving a body of a zirconium-cobalt alloy;

(b) evacuating the enclosure, heating the body of zirconium-cobalt alloy to dehydrogenate and expel gases therefrom, and saturating the body of zirconium-cobalt alloy at least a plurality of times to activate the zirconium-cobalt alloy; and (c) upon activation of the zirconium-cobalt alloy, admitting hydrogen or deuterium into contact with the zirconium-cobalt alloy to transform the body in part into a hydride constituting a reservoir of hydrogen or deuterium for subsequent controlled liberation thereof from the reservoir, and in part into a getter for elements interfering with spectral purity of a hydrogen discharge emission from the lamp.

Preferably the body is heated to 450° C. and evacuated to about $10^{-5}$ Pa repeatedly to dehydrogenate the body and is saturated with hydrogen by cooling same in steps of about 50° per 30 minutes in the presence of hydrogen to room temperature.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
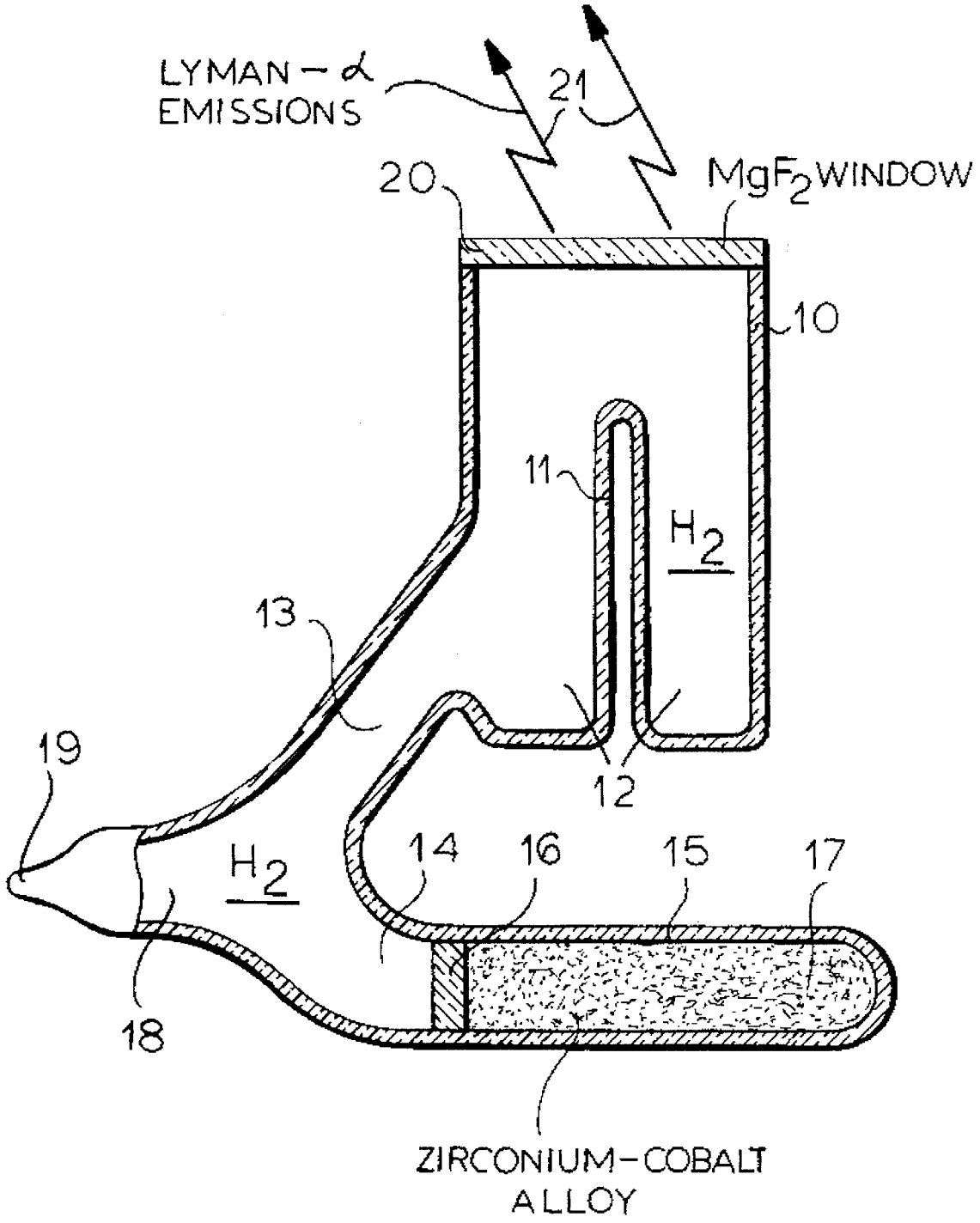
FIG. 1 is a hydrogen discharge lamp according to the invention.

As can be seen from FIG. 1, a glass bulb 10 is provided with a cemented $MgF_2$ (magnesium fluoride) window 20 from which the Lyman-α emissions 21 emerge when the bulb is excited.

The bulb 10, composed of glass, is cylindrical and is formed along its longitudinal axis with a capillary 11 to receive a transmitting antenna of a high frequency source, for example, a source in the 100 MHz range which can be fused into the capillary tube. The bulb 10 has an arm 13 connecting a side arm 15 to the bulb. The side arm 15 contains a body of zirconium-cobalt hydride as the hydrogen reservoir. When the side arm 15 is heated, hydrogen is liberated and passes through the fritted or sintered glass plug 16 into a space 14 communicating with the arm 13 and the chamber 12 surrounding the capillary 11.

Figure 2:
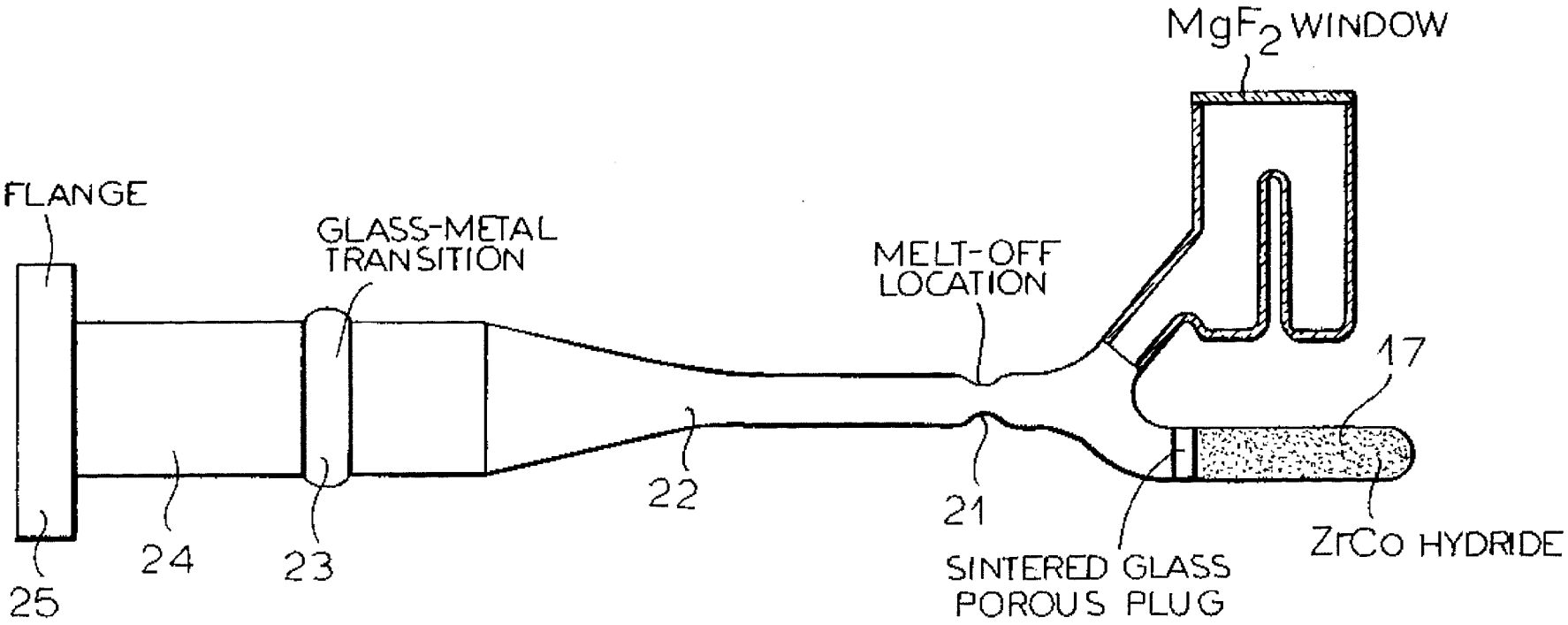
FIG. 2 is a view drawn to a somewhat smaller scale but showing the bulb of the lamp while it is still connected to the flange for evacuating same and admitting hydrogen thereto.

The bulb 10 of FIG. 1 is fused off from the structure shown in FIG. 2 in which the passage 18 is connected by the melt-off location 21 with a glass tube 22 connected to a glass-metal transition 23 from which a metal tube 24 extends to a CF 16 flange 25 which serves to connect the unit to the glass filling and evacuating system.

The lamp is manufactured in the following way. The assembly shown in FIG. 2 is connected by the flange 25 to a vacuum system so that a suction can be drawn in the blank to a pressure of $10^{-5}$ Pa. The zirconium-cobalt powder 17 in the side arm 15 is dehydrogenated by heating to a temperature of 450° C.

The zirconium-cobalt powder is held at this temperature for 24 hours and the blank is then again evacuated. Hydrogen is then admitted to the blank and the zirconium-cobalt powder is cooled stepwise to room temperature at about 50° C. for every 30 minutes, thereby hydrogenating the zirconium-cobalt alloy and forming zirconium-cobalt hydride.

The zirconium-cobalt hydride is again dehydrogenated by heating to 450° C. and evacuating the liberated hydrogen. This repetition of dehydrogenation and hydrogenation serves to activate the zirconium-cobalt.

After activation, sufficient hydrogen is admitted to convert half the zirconium-cobalt to hydride and the blank is again cooled stepwise in the manner described to room temperature. The nonhydride activated portion of the zirconium-cobalt serves as the getter. The lamp is filled with an inert gas and fused off from the blank, forming the seal 19 (FIG. 1).

In operation the lamp has its side arm 15 heated in a furnace to a constant temperature as set by a temperature-control unit conventional for use with such lamps. The temperature at which the zirconium-cobalt hydride is held determines the hydrogen partial pressure in accordance with the van 'T Hoff equation given above using the parameters for the zirconium-cobalt, A=4261 and B=11.93 (see Penzhorn, R. D.; Devillers M. and Sirch, M.: *Evaluation of ZrCo and Other Getters for Tritium Handling and Storage*, J. Nucl. Mat., (1990), 170, 217–231). The activated zirconium-cobalt reacts with any foreign atoms or molecules diffusing into the lamp or remaining therein and which would affect the spectral purity of the lamp.

Figure 3:
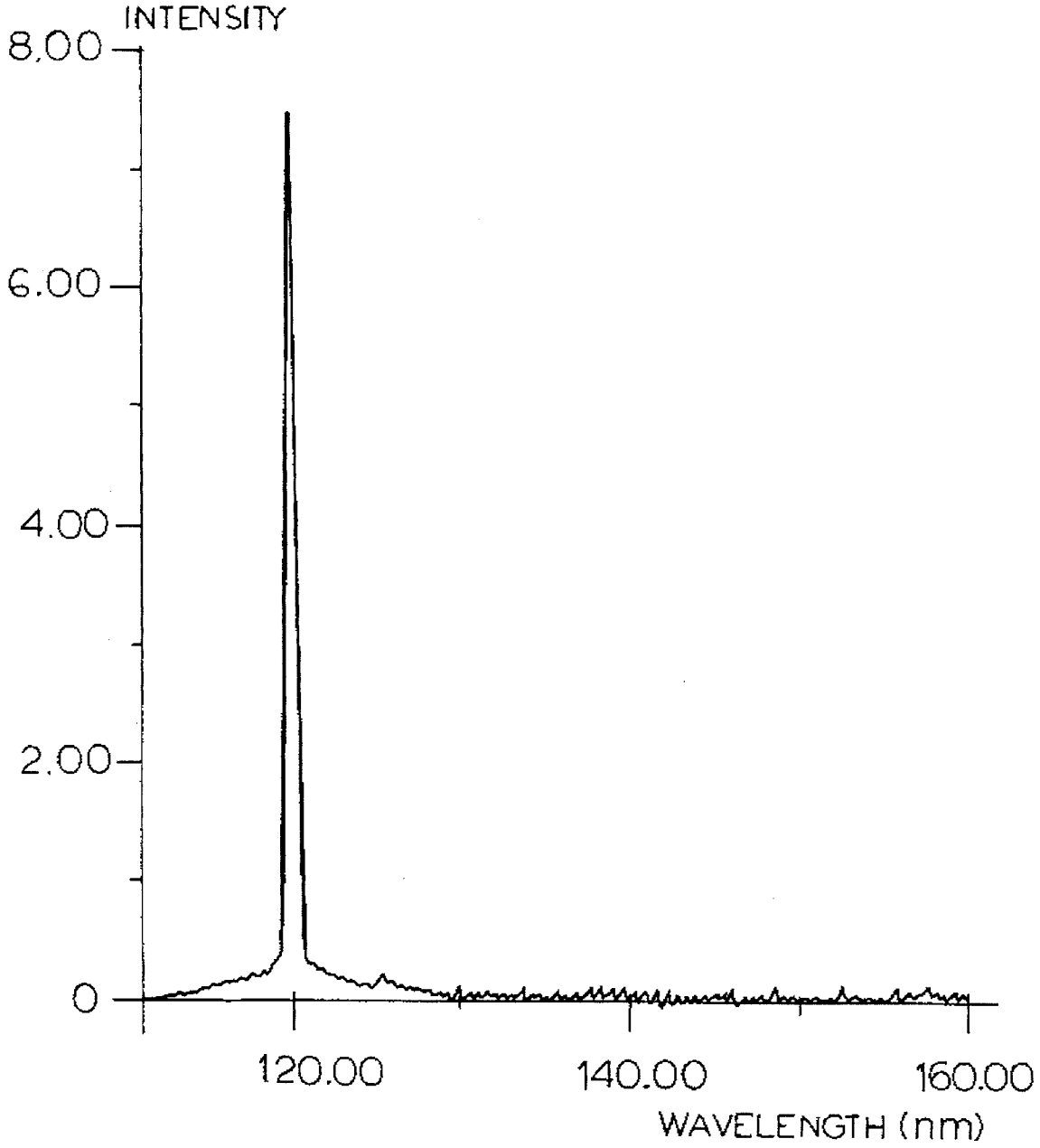
FIG. 3 is a diagram of the spectrum in a wavelength region of interest of the emissions from the lamp.

FIG. 3 shows the spectrum of the lamp using the zirconium-cobalt temperature in an atomic ratio of zirconium to cobalt of 1:1, excited by high frequency as described and utilizing a photomultiplier (1000 volts) with a monochromator as the radiation detector. The Lyman-α peak and the very low radiation intensity in adjacent wavelength ranges is clear. The replacement of uranium by zirconium-cobalt in the formation of the hydrogen discharge lamp is not limited to the high-frequency excited gas discharge lamps, but also is applicable to direct current and microwave-excited hydrogen lamps. The use of the zirconium-cobalt is not limited by the geometry of the lamp either.

We claim:

1. A hydrogen discharge lamp, comprising:

a glass lamp enclosure formed with a radiation emitting window;

means on said enclosure receiving a body of a zirconium-cobalt alloy forming in part a hydride constituting a reservoir of at least one element selected from the group which consists of hydrogen and deuterium for controlled liberation thereof from said reservoir, said zirconium-cobalt alloy simultaneously forming in part a getter for elements interfering with spectral purity of a hydrogen discharge emission from the lamp; and means for effecting an electrical discharge in the hydrogen or deuterium liberated into said enclosure for emitting light through said window.

2. The hydrogen discharge lamp defined in claim 1 wherein said zirconium-cobalt alloy has an atomic ratio of zirconium to cobalt of substantially 1:1.

3. The hydrogen discharge lamp defined in claim 1 wherein said glass lamp enclosure has a bulb formed with said window and provided with means for exciting gas in said bulb to produce said discharge, said means on said enclosure receiving said body of a zirconium-cobalt alloy including a sidearm containing said body of said zirconium-cobalt alloy and communicating with said bulb.

4. The hydrogen discharge lamp defined in claim 3, further comprising a fritted glass plate between said body of said zirconium-cobalt alloy and said bulb.

5. The hydrogen discharge lamp defined in claim 4, further comprising a flange affixed to said bulb for connecting same with a suction source.

6. The hydrogen discharge lamp defined in claim 5, further comprising a metal-to-glass transition between said flange and said bulb.

7. The hydrogen discharge lamp defined in claim 6 wherein said window is composed of $MgF_2$.

* * * * *